US006046440A

United States Patent [19]

Wright et al.

[11] Patent Number: 6,046,440

[45] Date of Patent: Apr. 4, 2000

[54] AUTOMATIC BURNER ACTUATION SWITCH

[76] Inventors: Matt Wright; Jim Speers, both of 6458 Wellington Rd. S., P.O. Box 310, Elora, Canada, N0B 1S0

[21] Appl. No.: 09/041,255

[22] Filed: Mar. 12, 1998

[51] Int. Cl.[7] ..... H05B 3/68

[52] U.S. Cl. ..... 219/457.1

[58] Field of Search ..... 219/446.1, 447.1, 219/451.1, 452.11, 457.1, 518

[56] References Cited

U.S. PATENT DOCUMENTS

| | | | |
|---|---|---|---|
| 2,155,425 | 4/1939 | Mere | 219/518 |
| 3,586,824 | 6/1971 | Barney | 219/518 |
| 4,214,150 | 7/1980 | Cunningham | 219/518 |
| 4,394,565 | 7/1983 | Dills | 219/518 |

*Primary Examiner*—Sang Paik

[57] ABSTRACT

A stove burner activation device is included with a microswitch having an actuator arm. The microswitch is connected between a power source and the ends of a heating element of a burner for providing power thereto upon the closing of the microswitch's internal contacts. Also included is a mounting assembly for mounting the microswitch to the bottom surface of a burner compartment below a center of a burner well of an associated one of the burners of a stove. Next provided is an actuator rod slidably situated within an aperture formed in the center of the burner well with a first end extended above the heating element of the burner and a second end coupled to the microswitch for closing its internal contacts thereof.

7 Claims, 2 Drawing Sheets

FIG. 2
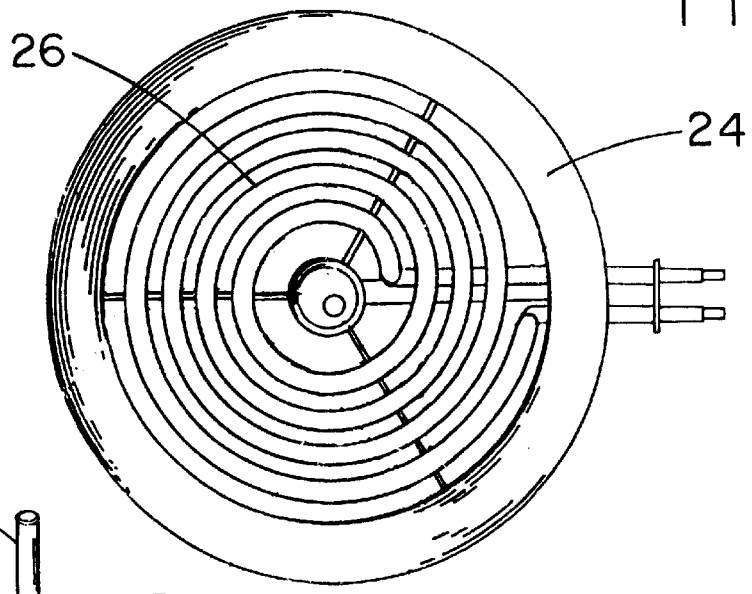
FIG. 3
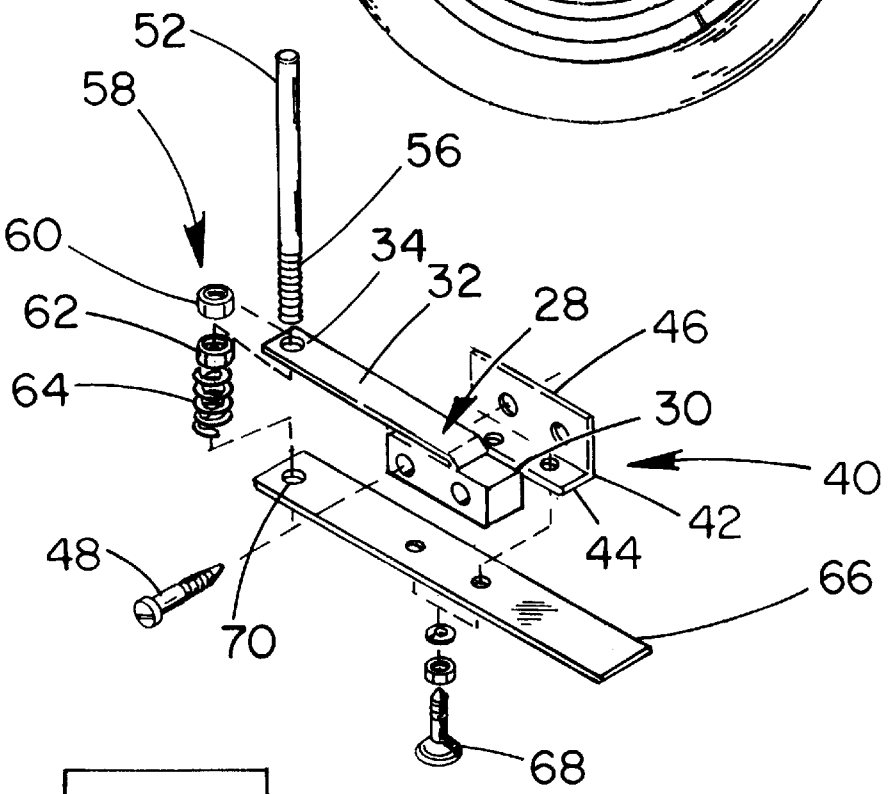
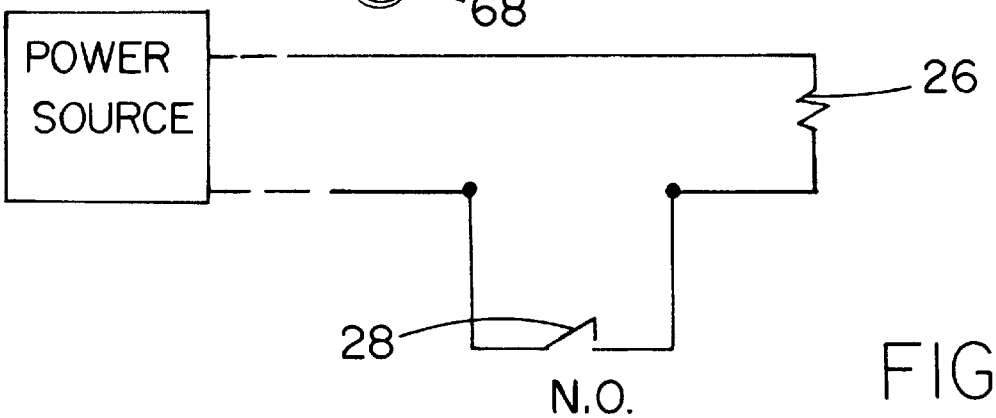
FIG. 4

AUTOMATIC BURNER ACTUATION SWITCH

BACKGROUND OF THE INVENTION

1. Field of the Invention

The present invention relates to burner shut off switches and more particularly pertains to a new automatic burner actuation switch for providing a switch discretely situated within a burner compartment of a stove and adapted to automatically actuate and deactuate a burner of the stove.

2. Description of the Prior Art

The use of burner shut off switches is known in the prior art. More specifically, burner shut off switches heretofore devised and utilized are known to consist basically of familiar, expected and obvious structural configurations, notwithstanding the myriad of designs encompassed by the crowded prior art which have been developed for the fulfillment of countless objectives and requirements.

Known prior art burner shut off switches include U.S. Pat. Nos. 5,424,512; U.S. Pat. No. 5,294,779; U.S. Pat. No. 4,499,368; U.S. Pat. No. 4,214,150; U.S. Pat. No. 5,296,684; and U.S. Pat. No. Des. 243,502.

In these respects, the automatic burner actuation switch according to the present invention substantially departs from the conventional concepts and designs of the prior art, and in so doing provides an apparatus primarily developed for the purpose of providing a switch discretely situated within a burner compartment of a stove and adapted to automatically actuate and deactuate a burner of the stove.

SUMMARY OF THE INVENTION

In view of the foregoing disadvantages inherent in the known types of burner shut off switches now present in the prior art, the present invention provides a new automatic burner actuation switch construction wherein the same can be utilized for providing a switch discretely situated within a burner compartment of a stove and adapted to automatically actuate and deactuate a burner of the stove.

The general purpose of the present invention, which will be described subsequently in greater detail, is to provide a new automatic burner actuation switch apparatus and method which has many of the advantages of the burner shut off switches mentioned heretofore and many novel features that result in a new automatic burner actuation switch which is not anticipated, rendered obvious, suggested, or even implied by any of the prior art burner shut off switches, either alone or in any combination thereof.

To attain this, the present invention generally comprises a stove having a planar top surface with a burner compartment situated therebelow. Such burner compartment is defined by a planar bottom surface situated in parallel relationship with the top surface of the stove, as shown in FIG. 1. The stove further has a plurality of burner wells each with a periphery coupled to the top face. As is conventional, each burner well resides within the burner compartment. A burner is mounted within each burner well. Each burner includes a single heating element with a spiral configuration which resides in a single horizontal plane. During use, the heating element of each burner is adapted to transmit heat upon the supply of power to a pair of ends thereof. Also included is a microswitch having an inboard portion. Such inboard portion has a rectilinear configuration with a top face, a bottom face, a pair of side faces, and a pair of end faces formed therebetween. As shown in FIG. 1, the microswitch has an actuator arm, and terminals, (normally open). As shown in the figures, a bore is formed in the end of the actuator arm. The microswitch is connected between a power source and the ends of the heating element of the burner for providing power thereto upon the biasing of the actuator arm downwardly. For maintaining the microswitch in its proper orientation, a mounting assembly is included in the form of an angle iron. Such angle iron is defined by a horizontal extent and a vertical extent with a pair of bores formed therein. The vertical extent of the angle iron is coupled to one of the side faces of the inboard extent of the microswitch via a pair of screws. The horizontal extent of the mounting assembly has a magnet situated thereon for mounting the same to the bottom of the burner compartment. It is imperative that the microswitch is mounted such that the bore in the actuator arm of the microswitch resides below a center of the burner well of an associated one of the burners of the stove. Next provided is a linear actuator rod slidably situated within an aperture formed in the center of the burner well and the bore of the actuator arm. A first end of the rod is extended above the heating element of the burner, approximately ⅜–½", and a second end of the rod has a plurality of threaded grooves formed therein. A pair of nuts, including a first nut, and a second nut is provided. The first nut is screwably coupled to the second end of the rod, and abuts a top surface of the actuator arm of the microswitch. The second nut is screwably coupled to the second end of the rod, and abuts a bottom surface of the actuator arm of the microswitch. By this structure, a bottom portion of the rod extends below the second nut a fixed predetermined length. Situated about the bottom portion of the rod, is a spring. The spring is constrained by the second nut, and the bottom surface of the burner compartment. As such, upon the placement of an article on the burner, the rod and actuator arm are biased downwardly for providing power to the heating element of the burner.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new automatic burner actuation switch apparatus and method which has many of the advantages of the burner shut off switches mentioned heretofore and many novel features that result in a new automatic burner actuation switch which is not anticipated, rendered obvious, suggested, or even implied by any of the prior art burner shut off switches, either alone or in any combination thereof.

It is another object of the present invention to provide a new automatic burner actuation switch which may be easily and efficiently manufactured and marketed.

It is a further object of the present invention to provide a new automatic burner actuation switch which is of a durable and reliable construction.

An even further object of the present invention is to provide a new automatic burner actuation switch which is susceptible of a low cost of manufacture with regard to both materials and labor, and which accordingly is then susceptible of low prices of sale to the consuming public, thereby making such automatic burner actuation switch economically available to the buying public.

Still yet another object of the present invention is to provide a new automatic burner actuation switch which provides in the apparatuses and methods of the prior art some of the advantages thereof, while simultaneously overcoming some of the disadvantages normally associated therewith.

Still another object of the present invention is to provide a new automatic burner actuation switch for providing a switch discretely situated within a burner compartment of a stove and adapted to automatically actuate and deactuate a burner of the stove.

Still another object of the present invention is the safety, and energy conservation aspect.

Even still another object of the present invention, is to provide a new automatic burner actuation switch that includes a microswitch having an actuator arm. The microswitch is connected between a power source and ends of a heating element of a burner for providing power thereto upon the closing of the contacts. Also included is a mounting assembly for mounting the microswitch to the bottom surface of a burner compartment below a center of a burner well of an associated one of the burners of a stove. Next provided is an actuator rod slidably situated within an aperture formed in the center of the burner well with a first end extended above the heating element of the burner and coupled to the actuator arm of the microswitch, for closing the contacts thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a top view of the heating element of the burner of the present invention.

FIG. 3 is a perspective view of an alternate embodiment of the present invention.

FIG. 4 is a schematic diagram of the present invention.

DESCRIPTION OF THE PREFERRED EMBODIMENT

Figure 1:
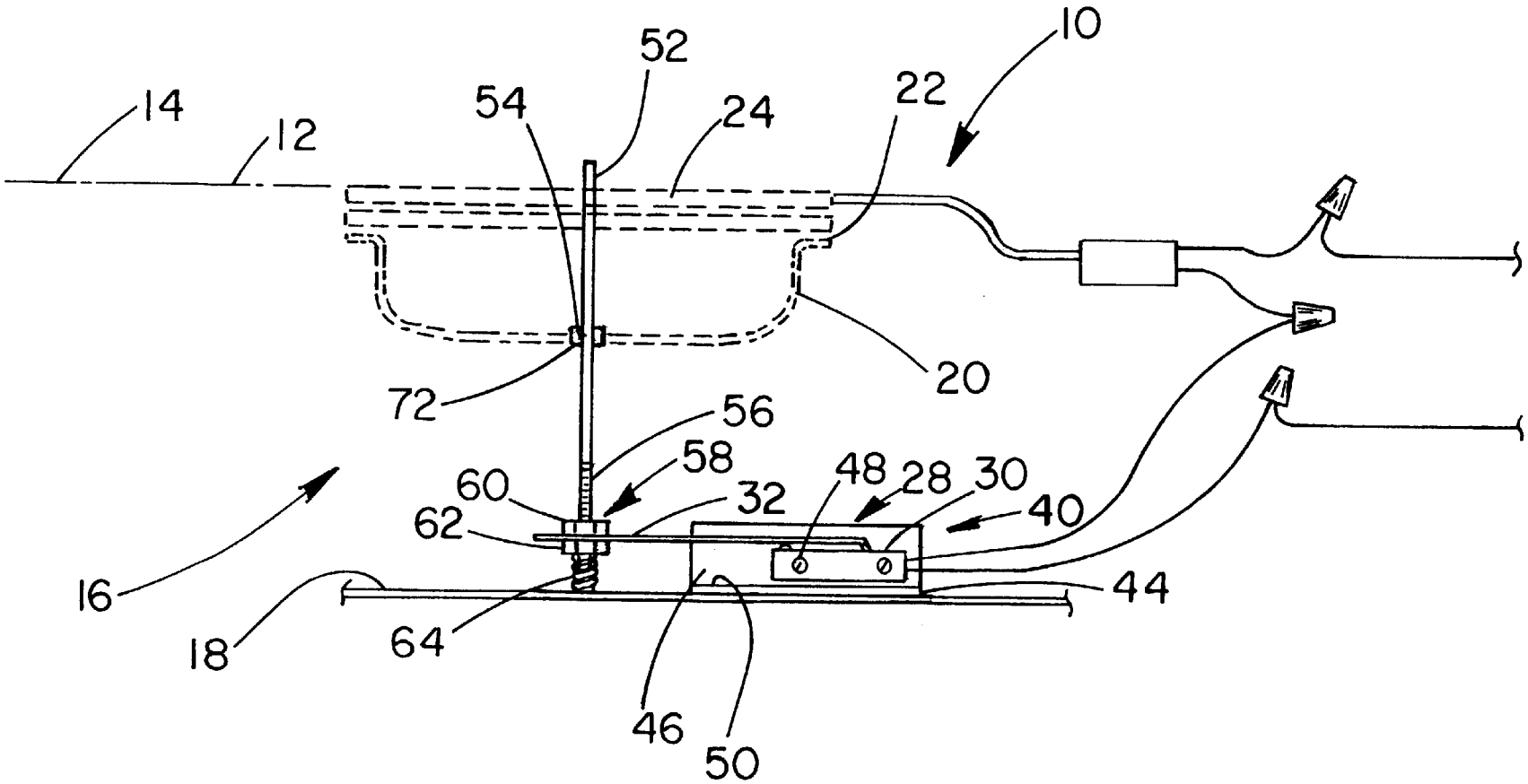
FIG. 1 is a side cross-sectional view of a new automatic burner actuation switch according to the present invention.

With reference now to the drawings, and in particular to FIGS. 1 through 4 thereof, a new automatic burner actuation switch embodying the principles and concepts of the present invention and generally designated by the reference numeral 10 will be described.

As best illustrated in the Figures, the system designated as numeral 10 includes a stove 12 having a planar top surface 14 with a burner compartment 16 situated therebelow. Such burner compartment is defined by a planar bottom surface 18 situated in parallel relationship with the top surface of the stove, as shown in FIG. 1. The stove further has a plurality of burner wells 20 each with a periphery 22 coupled to the top face. As is conventional, each burner well resides within the burner compartment. A burner 24 is mounted within each burner well. Each burner includes a single heating element 26 with a spiral configuration which resides in a single horizontal plane. During use, the heating element of each burner is adapted to transmit heat upon the supply of power to a pair of ends thereof.

Also included is a 20 Amp, 250 Volt microswitch 28 having an inboard portion 30. Such inboard portion has a rectilinear configuration with a top face, a bottom face, a pair of side faces, and a pair of end faces formed therebetween. As shown in FIG. 1, the microswitch has an actuator arm 32, or lever, which makes, or brakes the internal contacts of the switch when depressed downwardly, or released. As shown in the Figures, a bore 34 is formed in the actuator arm of the microswitch is connected between a power source and the ends of the heating element of the burner for providing power thereto, only upon the biasing of the rod and actuator arm downwardly.

For maintaining the microswitch in its proper orientation, a mounting assembly 40 is included in the form of an angle iron 42. Such angle iron is defined by a horizontal extent 44 and a vertical extent 46 with a pair of bores formed therein. The vertical extent of the angle iron is coupled to one of the side faces of the inboard extent of the microswitch via a pair of screws 48. Such screws are mounted through the bores and engage the inboard portion microswitch. The horizontal extent of the mounting assembly has a magnet 50 situated thereon for mounting the same to the bottom surface of the burner compartment. It is imperative that the microswitch is mounted such that the bore in the actuator arm resides below a center of the burner well of an associated one of the burners of the stove.

Next provided is a linear ⅛" actuator rod 52 slidably situated within a aperture 54 formed in the center of the burner well and the bore of the actuator arm of the microswitch. As an option, a bushing 72 may be positioned about the inner periphery of the bore of the burner well for preventing fluid from leaking into the burner compartment. A first end of the rod is extended above the heating element of the burner and a second end has a plurality of threaded grooves 56 formed therein. To ensure proper operation, it is important that a diameter of the rod be less than that of the bore of the actuator arm of the microswitch.

A pair of nuts 58, including a first nut 60, and a second nut 62, is provided. The first nut is screwably coupled to the second end of the actuator rod, and abuts the top surface of the actuator arm of the microswitch. The second nut is screwably coupled to the second end of the actuator rod, and abuts to the bottom surface of the actuator arm of the microswitch. By this structure, a bottom portion of the rod extends below the second nut and the actuator arm of the microswitch a fixed determined length. Situated about the bottom portion of the rod is a spring 64. The spring is constrained by the second nut and the bottom surface of the burner compartment. As such, upon placement of an article, such as a pan on the burner, the rod and actuator arm of the microswitch are biased downwardly, providing power to the heating element of the burner.

In an alternate embodiment, the mounting assembly includes a base plate 66 in lieu of the magnet 50. Note FIG. 3. Such a base plate is coupled to the bottom face of the angle iron support 42, and fastened to each other by a pair of screws through a pair of bores in the horizontal plane of the angle iron support. Four rubber coated legs 68 are screwably coupled to a bottom face of the base plate and are extended downwardly therefrom. The legs are thus adapted for resting on the bottom surface of the burner compartment. The base plate further has a aperture 70 through which the actuator rod is slidably situated. As such, the spring resides between the actuator arm of the microswitch and the base plate. This is important since without the magnet, the spring must be bounded by elements fixed with respect to the microswitch.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A stove burner activation system comprising, in combination:

a stove having a planar top surface with a burner compartment situated therebelow, the burner compartment having a planar bottom surface situated in parallel relationship with the top surface of the stove, the stove further having a plurality of burner wells each having a periphery coupled to the top surface, wherein each burner well resides in the burner compartment and a burner is mounted in each burner well, each burner being formed of a single heating element with a spiral configuration lying in a single horizontal plane, the heating element of each burner being adapted to transmit heat upon the supply of power to a pair of electrical terminal ends of the heating element; and a stove burner activation device comprising:

a microswitch having an inboard portion with a rectilinear configuration and having a top face, a bottom face, a pair of side faces, and a pair of end faces formed therebetween, the microswitch having an actuator arm with a planar rectangular configuration having a first end coupled to the top of the switch, the actuator arm extending outwardly from the top of the switch, the actuator arm having a bore formed in a second end thereof, the microswitch being electrically connected between a power source and the ends of the heating element of the burner for permitting the flow of power to the heating element upon the downward movement of the actuator arm of the microswitch into a lower position and blocking the flow of power to the heating element when the actuator arm is moved into an upper position;

a mounting assembly including an angle member with a horizontal extent and a vertical extent, the angle member having a pair of bores formed in the vertical extent, the vertical extent of the angle iron being coupled to one of the side faces of the inboard extent of the microswitch by a pair of screws, the horizontal extent of the mounting assembly having a magnet situated thereon for mounting to the bottom surface of the burner compartment such that the bore in the actuator arm of the microswitch resides below a center of the burner well of an associated one of the burners of the stove;

a linear actuator rod slidably situated through an aperture formed in the center of the burner well and the bore of the actuator arm of the microswitch, a first end of the actuator rod being extended above the heating element of the burner, and a second end of the actuator rod having a plurality of threads formed therein;

a pair of nuts, including a first nut threadedly coupled to the second end of the rod and abutting a top surface of the actuator arm of the microswitch, and a second nut threadedly coupled to the second end of the rod and abutting a bottom surface of the actuator arm of the microswitch, wherein a bottom portion of the rod extends a predetermined length below the second nut and the actuator arm of the microswitch; and a spring situated about the bottom portion of the actuator rod between the second nut and the bottom surface of the burner compartment for biasing the actuator rod upward and the actuator arm into the upper position, wherein placement of an article upon the burner moves the rod and the actuator arm of the microswitch downwardly for providing power to the heating element of the burner.

2. A stove burner activation device for use with a stove having a planar top surface with a burner compartment situated therebelow with a planar bottom surface situated in parallel relationship with the top surface of the stove, the stove further having a plurality of burner wells each with a periphery coupled to the top face wherein each burner well resides within the burner compartment and a burner is mounted within each burner well, each burner formed of a single heating element with a spiral configuration which resides in a single horizontal plane, the heating element of each burner adapted to transmit heat upon the supply of power to a pair of ends thereof, the device including:

a microswitch having an actuator arm, the microswitch having terminals adapted for connection between a power source and the ends of the heating element of the burner for selectively permitting and blocking the flow of power to the heating element from the power source;

a mounting assembly for mounting the microswitch to the bottom surface of the burner compartment below a center of the burner well of an associated one of the burners of the stove; and an actuator rod slidably situated through an aperture formed in the center of the burner well with a first end adapted for extending above the heating element of the burner and a second end coupled to the actuator arm of the microswitch for closing internal contacts of the microswitch thereof.

3. A stove burner activation device as set forth in claim 2 wherein the mounting assembly includes a magnet for coupling the microswitch to the bottom surface of the burner compartment.

4. A stove burner activation device as set forth in claim 2 and further including a spring for situating in the burner compartment below the burner well for urging the actuator rod upwardly.

5. A stove burner activation device as set forth in claim 2 wherein the mounting assembly includes a base plate, an angle member coupled to the base plate and coupled to the microswitch, the base plate further having an aperture through which the actuator rod is slidably situated, wherein a spring resides between the actuator arm of the microswitch and the base plate for biasing the actuator rod in an upward direction.

6. A stove burner activation device as set forth in claim 2 wherein a distance of the actuator rod between the first end and the actuator arm is adjustable.

7. A stove burner activation device for use with a stove having a planar top surface with a burner compartment situated therebelow, the burner compartment having a planar bottom surface situated in parallel relationship with the top surface of the stove, the stove further having a plurality of burner wells each having a periphery coupled to the top surface, wherein each burner well resides in the burner compartment and a burner is mounted in each burner well, each burner being formed of a single heating element with a spiral configuration lying in a single horizontal plane, the heating element of each burner being adapted to transmit heat upon the supply of power to a pair of electrical terminal ends of the heating element, the device comprising:

a microswitch having an inboard portion with a rectilinear configuration and having a top face, a bottom face, a pair of side faces, and a pair of end faces formed therebetween, the microswitch having an actuator arm with a planar rectangular configuration having a first end coupled to the top of the switch, the actuator arm extending outwardly from the top of the switch, the actuator arm having a bore formed in a second end thereof, the microswitch being adapted for electrical connection between a power source and the ends of the heating element of the burner for permitting the flow of power to the heating element upon the downward movement of the actuator arm of the microswitch into a lower position and blocking the flow of power to the heating element when the actuator arm is moved into an upper position;

a mounting assembly including an angle member with a horizontal extent and a vertical extent, an angle member having a pair of bores formed in the vertical extent, the vertical extent of the angle member being coupled to one of the side faces of the inboard extent of the microswitch by a pair of screws, the horizontal extent of the mounting assembly having a magnet situated thereon for mounting to the bottom surface of the burner compartment such that the bore in the actuator arm of the microswitch resides below a center of the burner well of an associated one of the burners of the stove;

a linear actuator rod slidably situated through an aperture formed in the center of the burner well and the bore of the actuator arm of the microswitch, a first end of the actuator rod being extended above the heating element of the burner, and a second end of the actuator rod having a plurality of threads formed therein;

a pair of nuts, including a first nut threadedly coupled to the second end of the rod and abutting a top surface of the actuator arm of the microswitch, and a second nut threadedly coupled to the second end of the rod and abutting a bottom surface of the actuator arm of the microswitch, wherein a bottom portion of the rod extends a predetermined length below the second nut and the actuator arm of the microswitch; and a spring situated about the bottom portion of the actuator rod for locating between the second nut and the bottom surface of the burner compartment for biasing the actuator rod upward and the actuator arm into the upper position such that placement of an article upon the burner can move the rod and the actuator arm of the microswitch downwardly for providing power to the heating element of the burner.

* * * * *